US008772618B2

(12) United States Patent
Matsumoto

(10) Patent No.: US 8,772,618 B2
(45) Date of Patent: Jul. 8, 2014

(54) MIXING AUTOMATIC ACCOMPANIMENT INPUT AND MUSICAL DEVICE INPUT DURING A LOOP RECORDING

(75) Inventor: Keisuke Matsumoto, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 550 days.

(21) Appl. No.: 13/194,839

(22) Filed: Jul. 29, 2011

(65) Prior Publication Data

US 2012/0097014 A1 Apr. 26, 2012

(30) Foreign Application Priority Data

Oct. 26, 2010 (JP) ..... 2010-239559

(51) Int. Cl.
*G10H 1/36* (2006.01)
*G10H 7/00* (2006.01)
*G10H 1/00* (2006.01)

(52) U.S. Cl.
CPC ..... *G10H 1/0033* (2013.01); *G10H 2250/641* (2013.01); *G10H 1/36* (2013.01); *G10H 1/0066* (2013.01)
USPC ..... 84/634

(58) Field of Classification Search
CPC ..... G10H 1/0025; G10H 7/00; G10H 1/0008; G10H 1/0066; G10H 1/38; G10H 2220/005; G10H 1/40; G10H 2210/066; G10H 2250/235; G10H 2210/076; G10H 2210/125; G10H 1/34; G10H 2210/201; G10H 1/02; G10H 7/12; G10H 2250/641
See application file for complete search history.

(56) References Cited

U.S. PATENT DOCUMENTS 6,740,804 B2 * 5/2004 Kawano et al. ..... 84/609
2010/0147138 A1 * 6/2010 Chamberlin et al. ..... 84/603

FOREIGN PATENT DOCUMENTS

JP 2006023569 1/2006
JP 2006023594 1/2006

OTHER PUBLICATIONS

English machine translation of JP2006-023569 published Jan. 26, 2006 by Roland Corp.
English machine translation of JP2006-023594 published Jan. 26, 2006 by Roland Corp.
Abstract of JP2006-023569 published Jan. 26, 2006 by Roland Corp.
Abstract of JP2006-023594 published Jan. 26, 2006 by Roland Corp.

* cited by examiner

*Primary Examiner* — Jeffrey Donels
(74) *Attorney, Agent, or Firm* — David W. Victor; Konrad Raynes Davda & Victor LLP

(57) ABSTRACT

Provided are a method, electronic musical instrument, and computer storage device for mixing automatic accompaniment input and musical device input during a loop recording. During a first loop recording, automatic accompaniment information is generated from a storage device having patterns of automatic accompaniment information. First musical device input is received from at least one coupled musical device. The first musical device input and the automatic accompaniment input based on the generated automatic accompaniment information are mixed to produce a first mixed output. The first mixed output in a recording memory. During a second loop recording following the first loop recording, the first mixed output is outputted from the recording memory. Second musical device input from the at least one coupled musical device is received while outputting the first mixed output. The received second musical device input and the first mixed output are mixed to produce second mixed output. The second mixed output is stored in the recording memory.

23 Claims, 6 Drawing Sheets

MIXING AUTOMATIC ACCOMPANIMENT INPUT AND MUSICAL DEVICE INPUT DURING A LOOP RECORDING

CROSS-REFERENCE TO RELATED FOREIGN APPLICATION

This application is a non-provisional application that claims priority benefits under Title 35, United States Code, Section 119(a)-(d) from Japanese Patent Application entitled "ELECTRONIC MUSICAL INSTRUMENT" by Keisuke Matsumoto, having Japanese Patent Application Ser. No. 2010-239559, filed on Oct. 26, 2010, which Japanese Patent Application is incorporated herein by reference in its entirety.

BACKGROUND OF THE INVENTION

1. Field of the Invention

The present invention relates to a method, electronic musical instrument, and computer storage device for mixing automatic accompaniment input and musical device input during a loop recording.

2. Description of the Related Art

Japanese Patent Application Nos. JP2006-023569 and JP2006-023594 describe recorders that are capable of mixing musical sounds stored in a memory device such as a Random Access Memory (RAM) with newly inputted musical sounds and multitrack-recording the mixed sounds in the memory device. By using such a recorder with a multitrack recording capability, loop phrases for automatic performance can be created by the so-called "loop recording" in which a loop segment with a predetermined length is looped (repeated), and performance sounds inputted in the respective loops are recorded in multitracks.

SUMMARY

Provided are a method, electronic musical instrument, and computer storage device for mixing automatic accompaniment input and musical device input during a loop recording. During a first loop recording, automatic accompaniment information is generated from a storage device having patterns of automatic accompaniment information. First musical device input is received from at least one coupled musical device. The first musical device input and the automatic accompaniment input based on the generated automatic accompaniment information are mixed to produce a first mixed output. The first mixed output in a recording memory. During a second loop recording following the first loop recording, the first mixed output is outputted from the recording memory. Second musical device input from the at least one coupled musical device is received while outputting the first mixed output. The received second musical device input and the first mixed output are mixed to produce second mixed output. The second mixed output is stored in the recording memory.

In a further embodiment, the generated automatic accompaniment information comprises one segment of automatic accompaniment information selected by a user through a user interface.

In a further embodiment, a user tempo is received through the user interface when the user selects the segment of the automatic accompaniment information. During the first loop recording, a loop end point is calculated from the user selected automatic accompaniment information and the user tempo, wherein the first musical device input is received until the loop end point is reached or in response to the user selecting to end the first loop recording through the user interface. During the second loop recording, the second musical device input is received until the loop end point is reached or in response to the user selecting to end the second loop recording through the user interface.

In a further embodiment, the automatic accompaniment input based on the generated automatic accompaniment information comprises the automatic accompaniment information and the first and second musical device inputs comprise performance information. During the first loop recording, the first mixed output is transmitted to a sound source. The sound source outputs musical sounds based on the first mixed output, wherein the first mixed output includes the mixed generated automatic accompaniment information and the performance information from the at least one musical device before being processed by the sound source.

In a further embodiment, during the second loop recording, the sound source outputs musical sounds based on the second mixed output. The second mixed output includes the first mixed output comprising the automatic accompaniment information and the performance information mixed during the first loop recording and the received second musical device input.

In a further embodiment, during the first loop recording, a sound source outputs first musical sounds from the automatic accompaniment information generated from the storage device, wherein the automatic accompaniment input comprises the musical sounds from the sound source. The sound source further outputs second musical sounds from performance information from the at least one musical device. The first musical device input comprises the second musical sounds from the sound source and the first mixed output comprises the mixing of the first and second musical sounds.

In a further embodiment, during the second loop recording, the sound source outputs third musical sounds from performance information from the at least one musical device. The second musical device input comprises the third musical sounds from the sound source. The sound source further outputs fourth musical sounds based on the second mixed output. The second mixed output includes the first mixed output and the third musical sounds received while outputting the musical sounds from the second mixed output.

In a further embodiment, during the second loop recording, automatic accompaniment information is not generated from the storage device to provide to the mixing to produce the second mixed output during the second loop recording.

In a further embodiment, during the second loop recording, generating from the storage device the automatic accompaniment information configured so that any produced sounds from the automatic accompaniment information are muted. The automatic accompaniment information generated from the storage device during the second loop recording is not included in the second mixed output and is not recorded on the recording memory with the second mixed output.

In a further embodiment, rendering on a display device information on the automatic accompaniment information generated during the second loop recording.

In a further embodiment, the at least one coupled musical device comprises at least one of a keyboard, external (Musical Instrument Digital Interface) MIDI equipment coupled via a MIDI interface, and a microphone.

DETAILED DESCRIPTION

Figure 1:
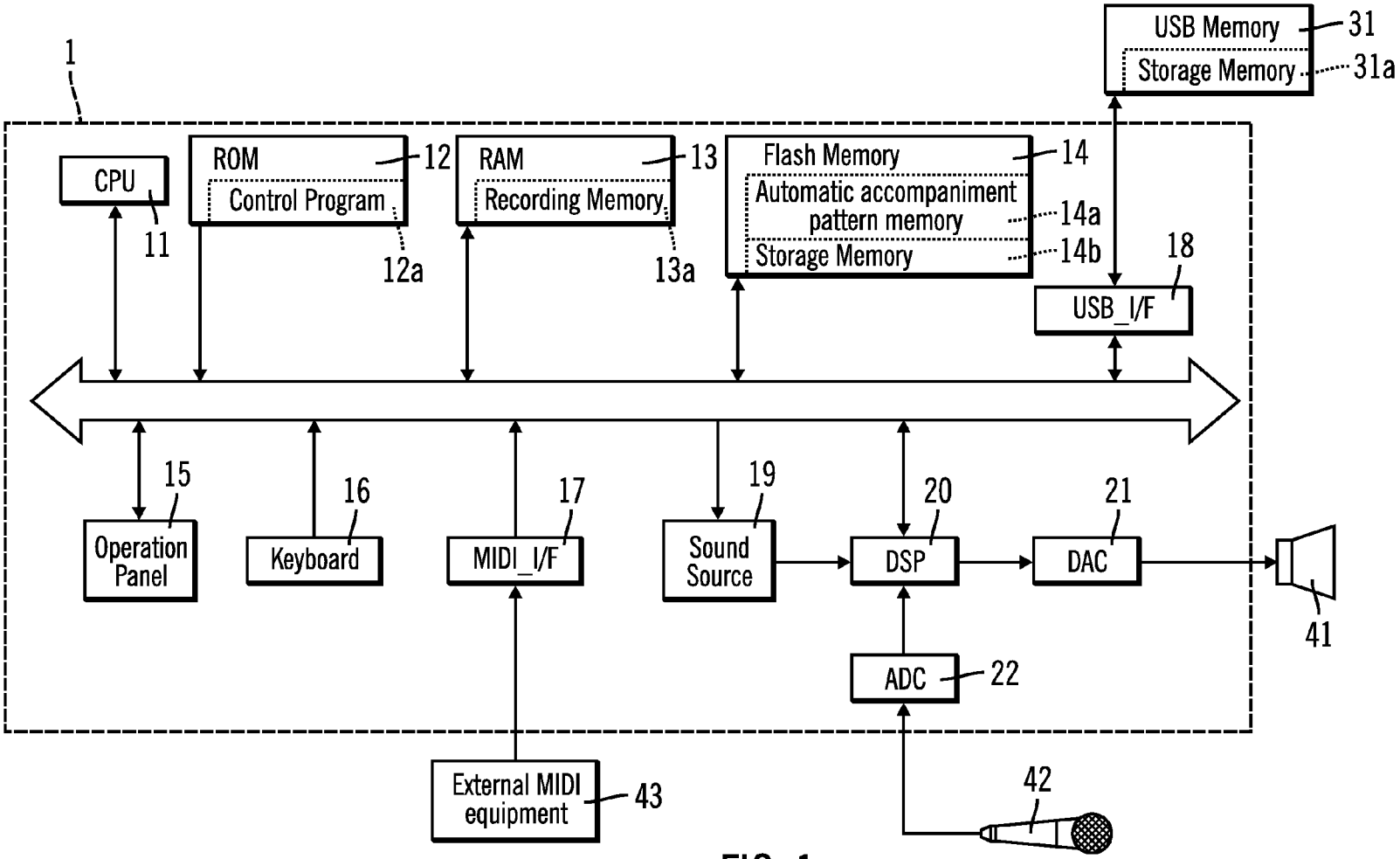
FIG. 1 is a block diagram showing the configuration of an electronic musical instrument in accordance with an embodiment of the invention.

Problems may be encountered when performance sounds performed by the performer along with accompaniment sounds are recorded in multi-tracks by loop recording, such as by using the recorders described in Japanese Patent Application Nos. JP2006-023569 and JP2006-023594 described above. For example, when the accompaniment sounds repeated in the second and later rounds are overdubbed on the accompaniment sounds recorded in the first round generally at the same timing, the waveforms may be unintentionally amplified in its level, and timbres that sound like those with shifted phases may be generated, such that the sound quality of the loop phrases obtained can be deteriorated.

Described embodiments address these problems by providing an electronic musical instrument that can create loop phrases including accompaniment sounds with good sound quality, when the loop phrases are created by loop recording.

In one embodiment of an electronic musical instrument, accompaniment sounds or musical sounds including accompaniment sounds are stored in a storage device and the musical sounds in a predetermined segment are read out sequentially from the storage device by a loop reproduction device. The musical sounds sequentially readout and at least one of the accompaniment sounds sequentially generated by an accompaniment sound generation device and performance sounds sequentially inputted are mixed by a loop storage control device and sequentially stored in the storage device while looping the predetermined segment. The loop storage control device may be controlled by the accompaniment sound storage control device to store the accompaniment sounds sequentially generated by the accompaniment sound generation device in the storage device for only one round of a loop of the predetermined segment. Therefore, the accompaniment sounds sequentially generated by the accompaniment sound generation device are not stored in a manner repeatedly overdubbed in the storage device. This is effective in preventing occurrence of flaws that adversely affect the sound quality, such as unintentional amplification of the waveforms of the accompaniment sounds stored in the storage device, occurrence of timbres that sound like those with shifted phases and the like, whereby loop phrases with good sound quality can be created.

In certain embodiments, to store the accompaniment sounds sequentially generated by the accompaniment sound generation device in the storage device for only one round of a loop of the predetermined segment, may involve not only a configuration that stores the accompaniment sounds only for one round of the loop, but also substantially equivalent configurations that store the accompaniment sounds only for one round of a loop, including a configuration that stores the accompaniment sounds for one round with a suitable sound volume level and stores other parts exceeding the one round with a sound volume level substantially smaller compared to the suitable sound volume level. Further, in certain embodiments, the storing of the accompaniment sounds sequentially generated by the accompaniment sound generation device in the storage device for only one round of a loop of the predetermined segment may no not be limited to storing the accompaniment sounds for only one round from the start to the end of the predetermined segment, but also may include storing the accompaniment sounds for one round from a predetermined position within the predetermined segment to the predetermined position in the next loop.

In a further embodiment of an electronic musical instrument, performance information (such as performance information of accompaniment sounds or performance information based on performance) are stored in a storage device. When the performance information in a predetermined segment is read out sequentially from the storage device by a loop reproduction device and reproduced in a loop, the performance information sequentially readout and at least one of performance information of accompaniment sounds sequentially generated by an accompaniment sound generation device and performance information based on performance sequentially inputted are merged by a loop storage control device and sequentially stored in the storage device while looping the predetermined segment. The loop storage control device is controlled by the accompaniment sound storage control device to store the performance information of the accompaniment sounds sequentially generated by the accompaniment sound generation device in the storage device for only one round of a loop of the predetermined segment. Therefore, accompaniment sounds based on the performance information for one round of a loop stored in the storage device may not be outputted as sounds in a manner overdubbed on accompaniment sounds sequentially generated thereafter by the accompaniment sound generation device. This is effective in preventing occurrence of flaws that adversely affect the sound quality, such as unintentional amplification of the level of waveforms of the accompaniment sounds generated based on the performance information stored in the storage device, occurrence of timbres that sound like those with shifted phases and the like, whereby loop phrases with good sound quality can be created.

In certain embodiments, to store performance information of the accompaniment sounds sequentially generated by the accompaniment sound generation device in the storage device for only one round of a loop of the predetermined segment, may involve not only a configuration that stores performance information of the accompaniment sounds only for one round of the loop, but also substantially equivalent configurations that store the performance information only for one round of a loop, such as, a configuration that stores the performance information to create accompaniment sounds for one round with a suitable sound volume level and stores performance information to create accompaniment sounds exceeding the one round with a sound volume level substantially smaller compared to the suitable sound volume level.

Further, in certain embodiments, storing performance information of the accompaniment sounds sequentially generated by the accompaniment sound generation device in the storage device for only one round of a loop of the predetermined segment may not be limited to storing the performance information for only one round of the loop from the start to the end of the predetermined segment, but may also include storing the performance information for one round from a predetermined position within the predetermined segment to the predetermined position in the next loop.

Embodiments of the invention will be described below, with reference to the accompanying drawings.

FIG. 1 is a block diagram of the configuration of an electronic musical instrument 1 in accordance with an embodiment of the invention. The electronic musical instrument 1 has a loop recording function, and is configured to be able to create loop phrases, using the loop recording function, in which performance sounds based on inputs from a keyboard 16 or the like by the performer are overdubbed on accompaniment sounds by automatic accompaniment (automatic performance). When creating a loop phrase including accompaniment sounds by the automatic accompaniment, the electronic musical instrument 1 may control such that the automatic accompaniment is stopped at the time of overdub-recording (multitrack recording) in the second and later rounds in the loop recording so that the loop phrase can be created with good sound quality.

As shown in FIG. 1, the electronic musical instrument 1 includes a Central Processing Unit (CPU) 11, a Read Only Memory (ROM) 12, a Random Access Memory (RAM) 13, a flash memory 14, an operation panel 15, a keyboard 16, a Musical Instrument Digital Interface (MIDI) Interface (I/F) 17, a Universal Serial Bus (USB) Interface (I/F) 18, a sound source 19, a digital signal processor (DSP) 20, a digital analog converter (DAC) 21, and an analog-digital converter (ADC) 22. The devices 11 through 20 except the DAC 21 and the ADC 22 are connected to one another through a bus line 23. The DAC 21 and the ADC 22 are connected to the DSP 20, respectively.

Figure 3:
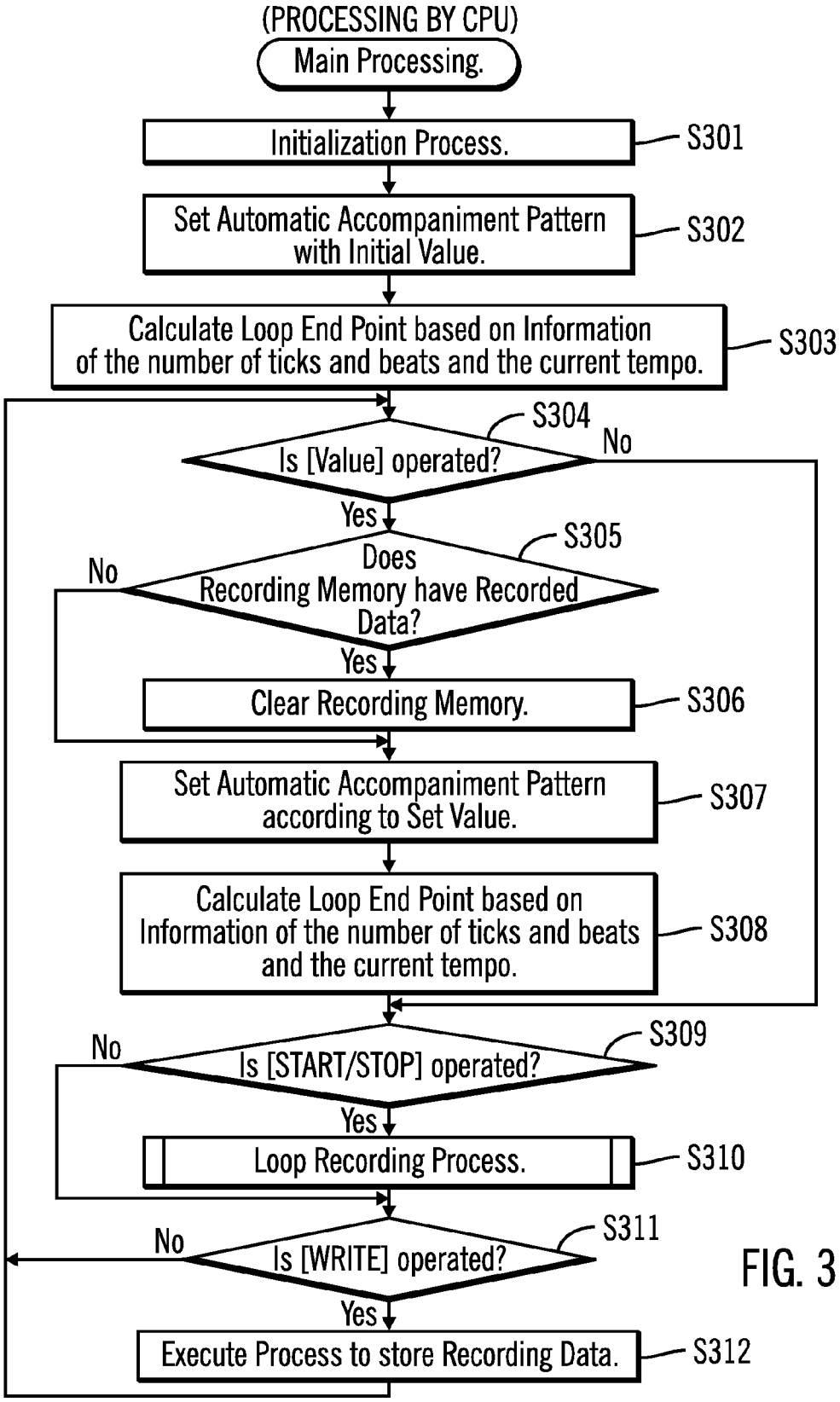
FIG. 3 is a flow chart of a main processing that is executed by the electronic musical instrument.
Figure 4:
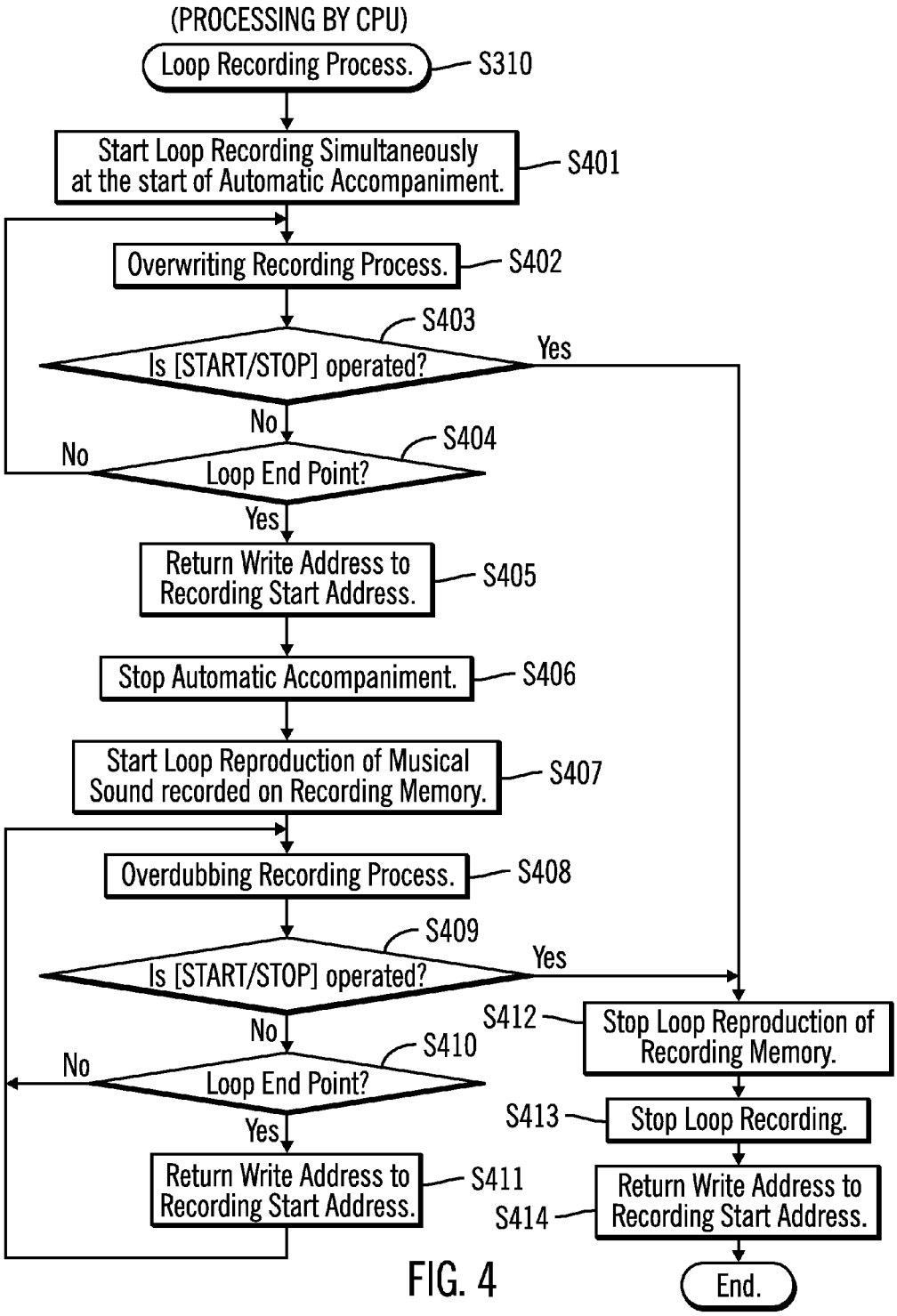
FIG. 4 is a flow chart of a loop recording processing that is executed in the main processing.

The CPU 11 is a central control device that controls each of the devices of the electronic musical instrument 1 according to fixed value data and control programs stored in the ROM 12 and the RAM 13. The ROM 12 is a rewritable memory, and stores a control program 12*a* to be executed by the CPU 11, and fixed value data (not shown) that are referred to by the CPU 11 when executing the control program 12*a*. It is noted that each of the processing steps shown in the flow charts of FIG. 3 and FIG. 4 is executed by the control program 12*a*.

The RAM 13 is a rewritable memory, and has a work area (not shown) for temporarily storing various data to be used for executing the control program 12*a* by the CPU 11. The RAM 13 has a recording memory 13*a*. The recording memory 13*a* stores recording data (audio signals of musical sounds, in accordance with the present embodiment) obtained by a loop recording processing (see FIG. 4).

The flash memory 14 is a rewritable nonvolatile memory, and includes an automatic accompaniment pattern memory 14*a* and a storage memory 14*b*. The automatic accompaniment pattern memory 14*a* stores multiple automatic accompaniment patterns composed of MIDI data (performance information). The multiple automatic accompaniment patterns stored in the automatic accompaniment pattern memory 14*a* include one or a plurality of patterns for each of the music styles (for example, pop, jazz, rock, etc.). Also, the multiple automatic accompaniment patterns stored in the automatic accompaniment pattern memory 14*a* may include sounds of a metronome, drums patterns and the like. Each of the automatic accompaniment patterns stored in the automatic accompaniment pattern memory 14*a* is managed by a number specifying each of the automatic accompaniment patterns (i.e., an automatic accompaniment pattern number). Performance information (MIDI data) composing the automatic performance patterns may be hereinafter referred to as "automatic accompaniment performance information." The storage memory 14*b* stores loop phrases that are created by overdubbing recording by the loop recording processing (see FIG. 4).

The operation panel 15 is configured to have various operation elements for operating the electronic musical instrument 1, a display that displays a variety of information based on operations of the electronic musical instrument 1. The operation panel 15 is provided with a variety of operation elements necessary for loop recording, as described below with reference to FIG. 2.

The keyboard 16 is configured with multiple white keys and black keys. As the keyboard 16 is operated (through depressing or releasing keys) by the performer, MIDI data composed of note-on information including sound pitch information, sound volume information, etc., note-off information indicating release of keys, etc., and the like are supplied to the sound source 19, based on the control of the CPU 11. MIDI data (performance information) supplied to the sound source 19 upon operation of the keyboard 16 by the performer may be referred to below as "manual performance information."

The MIDI_I/F 17 is an interface for connecting with external MIDI equipment 43 (for example, a MIDI keyboard or the like). MIDI data as performance information outputted from the external MIDI equipment 43 is supplied to the sound source 19 through the MIDI_I/F 17. Performance information (MIDI data) that is inputted from the external MIDI equipment 43 through the MIDI I/F 17 and supplied to the sound source 19 may be referred to below as "external MIDI performance information."

The USB I/F 18 is an interface for connecting with a USB memory 31. By connecting the USB memory 31 to the USB I/F 18, a loop phrase that is created by overdub recording by the loop recording processing (see FIG. 4) can be stored in a storage memory 31*a* provided in the USB memory 31, instead of the storage memory 14*b*. Alternatively, a loop phrase stored in the storage memory 14*b* can be copied or moved to the storage memory 31*a* of the USB memory 31. By storing loop phrases created by the electronic musical instrument 1 in the USB memory 31 (in the storage memory 31*a*), the created loop phrases can be used by other electronic musical instruments, PCs, audio equipment and the like.

The sound source 19 generates musical sounds (audio signals) with various pitches, sound volumes and timbres according to each performance information from musical sound waveforms stored in a built-in waveform memory (not shown) based on automatic accompaniment performance information, manual performance information or external MIDI performance information, or stops generation of these musical sounds. The waveform memory (not shown) stores musical sound waveforms of various timbres (for example, those of the piano, the guitar and the like) according to each pitch.

Musical sounds that are digital signals outputted from the sound source 19 are inputted in the DAC 21, converted by the DAC 21 into analog signals, and outputted. The DAC 21 is connected to a speaker 41 through an amplifier (not shown), and musical sounds of the analog signals converted by the DAC 21 are amplified by the amplifier and outputted as sounds from the speaker 41.

The ADC 22 is connected to a musical sound input device such as a microphone 42. Musical sounds (for example, performance sounds such as human voice) of analog signals inputted from the microphone 42 to the ADC 22 are converted into digital signals by the ADC 22, and outputted to the DSP 20. It is noted that musical sounds inputted from the musical sound input device such as the microphone 42 through the ADC 22 may be referred to as "externally inputted sounds." Also, as the musical sound input device to be connected to the ADC 22 may be an electrical musical instrument such as the electric guitar, the electric base or the like, or an electronic musical instrument such as the synthesizer, other than the microphone 42 described above. In other words, analog signals outputted from the electric musical instrument or the electronic musical instrument may be inputted as externally inputted sounds in the electronic musical instrument 1 through the ADC 22. It is noted that analog signals outputted as externally inputted sounds from the electric musical instrument such as the electric guitar, the electric base or the like may be inputted in the ADC 22 through a pre-amplifier and various kinds of effectors.

The electronic musical instrument 1 in accordance with the present embodiment having the configuration described above is capable of overdub-recording (multitrack recording) at least one of performance sounds based on manual performance information inputted from the keyboard 16, performance sounds based on the external MIDI performance information inputted through the MIDI I/F 17, and externally inputted sounds inputted through the ADC 22 onto accompaniment sounds based on an automatic performance pattern (automatic accompaniment performance information), using the loop recording function.

Figure 2:
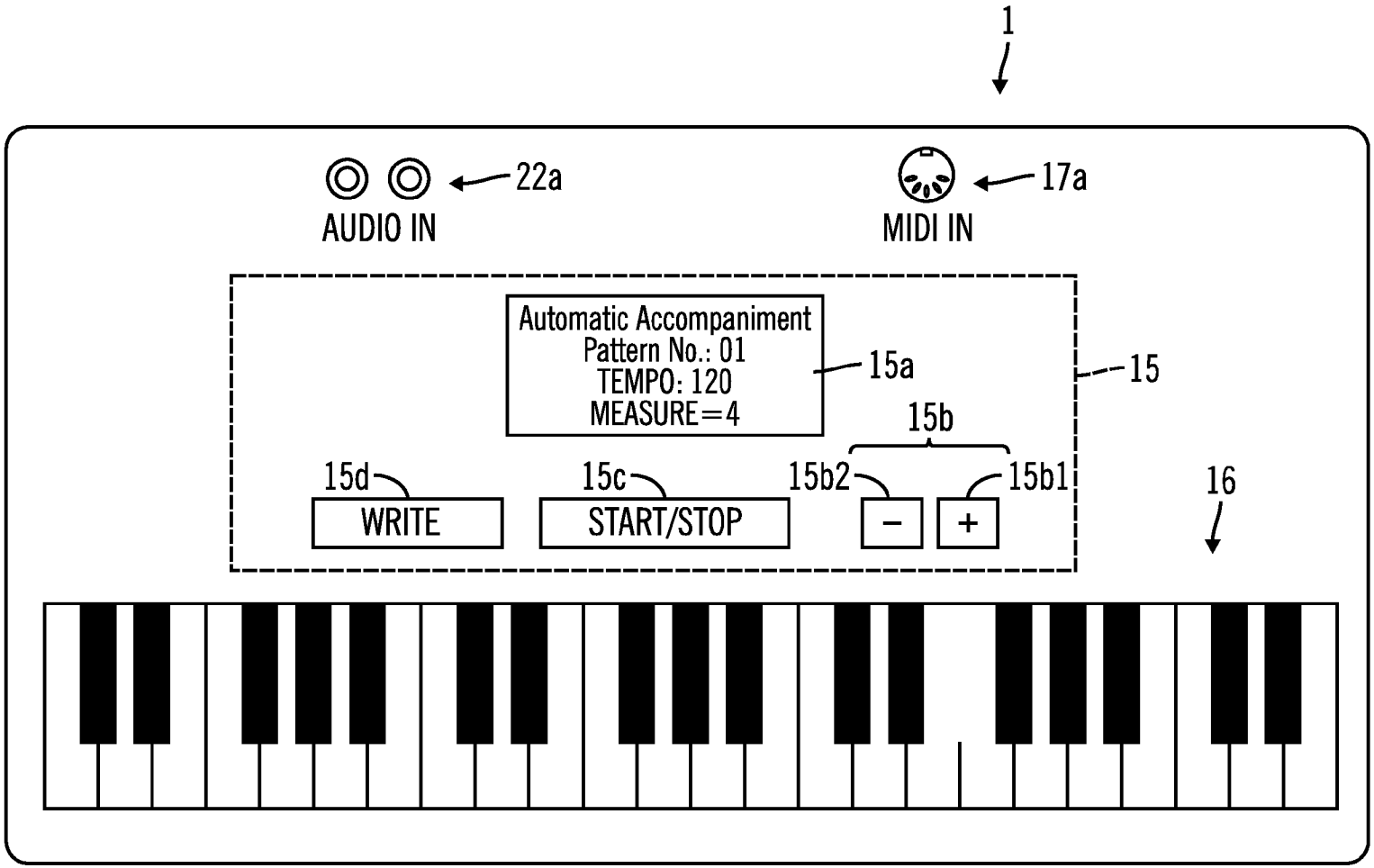
FIG. 2 is a schematic diagram of an embodiment of the exterior appearance of an electronic musical instrument.

Next, referring to FIG. 2, the aforementioned operation panel 15 is described. FIG. 2 is a schematic diagram showing an example of the exterior appearance of the electronic musical instrument 1. As shown in FIG. 2, the operation panel 15 is provided above the keyboard 16.

The operation panel 15 is provided with a liquid crystal display (LCD) 15*a*, VALUE buttons 15*b*, a START/STOP button 15*c*, and a WRITE button 15*d*. The LCD 15*a* has a display screen for displaying various kinds of information based on operations of the electronic musical instrument 1. As shown in FIG. 2, the LCD 15*a* displays an automatic accompaniment pattern number indicating the currently set automatic accompaniment pattern, the current performance tempo, and the length of performance corresponding to the set automatic accompaniment pattern. More specifically, in the example shown in FIG. 2, the LCD 15*a* displays "Automatic Accompaniment Pattern Number: 01", "TEMPO=120" and "MEASURE=4." This display indicates that an automatic accompaniment pattern with the automatic accompaniment pattern number being "01" is currently set, the current tempo is "120" and the length of performance of the set automatic accompaniment pattern is "4 measures."

The VALUE buttons 15*b* are operation elements for increasing or decreasing the numerical value of each of the parameters. The VALUE buttons 15*b* may be used, for example, to allow the performer to select one automatic accompaniment pattern to be automatically performed from among a plurality of automatic accompaniment patterns stored in the automatic accompaniment pattern memory 14*a*. The VALUE buttons 15*b* may be composed of a plus ("+") button 15*b*1 to increase the numerical value and a minus ("–") button 15*b*2 to decrease the numerical value. When selecting one automatic accompaniment pattern, the performer operates the "+" button 15*b*1 or the "–" button 15*b*2 as necessary, to increase or decrease the value of the displayed automatic accompaniment pattern number to reach an automatic accompaniment pattern number value associated with the desired automatic accompaniment pattern, thereby selecting the one automatic accompaniment pattern. Also, the VALUE buttons 15*b* may also be used for setting the value of the tempo (TEMPO).

The START/STOP button 15*c* is an operation element for indicating the start and the end of the loop recording. When the performer operates the START/STOP button 15*c* in a state in which a loop recording is not set, the loop recording by a loop recording processing to be described below (see FIG. 4) is started. On the other hand, when the performer operates the START/STOP button 15*c* while the loop recording is executed, the loop recording being executed can be ended.

The WRITE button 15*d* is an operation element that makes recording data stored (recorded) in the recording memory 13*a* of the RAM 13 to be stored in either the storage memory 14*b* of the flash memory 14 or the storage memory 31*a* of the USB memory 31. Storing the data in the storage memory 14*b* or in the storage memory 31*b* may be designated by an unshown operation element provided on the operation panel 15.

Also, as shown in FIG. 2, the electronic musical instrument 1 is provided with an audio input terminal 22*a* and a MIDI input terminal 17*a* above the operation panel 15. The audio input terminal 22*a* is a terminal for connecting with a musical sound input device such as the microphone 42. For example, by inserting the terminal of the microphone 42 in the terminal 22*a*, the microphone 42 can be connected to the ADC 22. Also, the MIDI input terminal 17*a* is a terminal for connecting with an external MIDI equipment 43. For example, by inserting the terminal of the external MIDI equipment 43 in the terminal 17*a*, the external MIDI equipment 43 can be connected to the MIDI_I/F 17.

Next, referring to FIG. 3, a main processing executed by the CPU 11 having the configuration described above will be described. FIG. 3 is a flow chart showing the main processing executed by the CPU 11.

The main processing starts up as the power is turned on the electronic musical instrument 1, and executes a process of initializing the electronic musical instrument 1 (for example, initialization of the registers and flags) (S301), and sets an automatic accompaniment pattern with an initial value (for example "01") among automatic accompaniment pattern numbers (S302). Then, a loop end point of the automatic accompaniment pattern is calculated based on information of the number of ticks and beats of the automatic accompaniment pattern set in S302, and the current tempo (S303).

After the process in S303, it is judged as to whether or not the VALUE buttons 15B (15*b*1 or 15*b*2) are operated (S304). When the VALUE buttons 15*b* are not operated, and thus the judgment is negative (S304: No), the processing proceeds to S309).

On the other hand, when it is judged that the VALUE buttons 15B are operated (S304: Yes), it is then judged as to whether or not the recording memory stores recorded data (S305). When the judgment in S305 is affirmative (S305: Yes), the content in the recording memory 13*a* is cleared (cleared to zero) (S306), and the processing proceeds to S307. When the judgment in S305 is negative (S305: No), the processing proceeds to S307, without performing the process in S306.

In S307, an automatic accompaniment pattern is set according to the set value of the automatic accompaniment pattern number set by the operation of the VALUE buttons 15*b* (S307). Next, a loop end point of the automatic accompaniment pattern is calculated from information of the number of ticks and beats of the automatic accompaniment pattern set in S307, and the current tempo (S308), and the processing proceeds to S309.

In step S309, it is judged as to whether or not the START/STOP button 15*c* is operated (S309). When it is judged that the START/STOP button 15*c* is operated (S309: Yes), a loop recording process is executed (S310). It is noted that detailed processes to be executed in the loop recording process (S310) will be described below with reference to FIG. 4. After executing the loop recording process (S310), the processing proceeds to S311. On the other hand, when the START/STOP button 15*c* is not operated, and the judgment in S309 is negative (S309: No), the processing also proceeds to S311.

In S311, it is judged as to whether or not the WRITE button 15*d* is operated (S311). When it is judged that the WRITE button 15*d* is operated (S311: Yes), recorded data recorded in the recording memory 13*a* is stored in the storage memory 14*b* or the storage memory 31*a* as designated as a destination storage (S312), and the processing is returned to S304. On the other hand, when the WRITE button 15*d* is not operated, and the judgment in S311 is also negative (S311: No), the processing is returned to S304.

Next, referring to FIG. 4, the aforementioned loop recording process (S310) will be described. FIG. 4 is a flow chart showing the loop recording process (S310) to be executed in the main process. When the loop recording process (S310) is started, automatic accompaniment performance information with the readout start address in the automatic accompaniment pattern set in S302 or S307 is read out, and supplied to the sound source 19 to start the automatic accompaniment, and a loop recording onto the recording memory 13*a* is started at the recording start address at the same time as the start of the automatic accompaniment (in other words, in synchronism with the start of the automatic accompaniment (S401).

After the process in S401, recording in the first round in the loop recording is performed on the recording memory 13*a* by an overwriting recording process (S402). Musical sounds (audio signals) generated by the sound source 19 based on the automatic accompaniment information are recorded through overwriting at the recording start address on the recording memory 13*a*. At this time, when performance information (manual performance information, external MIDI performance information) is inputted from the keyboard 16 or the external MIDI equipment 43 along with the automatic accompaniment, mixed sounds of the musical sounds generated by the sound source 19 based on the performance information and the musical sounds of the automatic accompaniment are recorded through overwriting on the recording memory 13*a*. Alternatively, when externally inputted sounds are inputted from the microphone 42 through the ADC 22 along with the automatic accompaniment, mixed sounds of the externally inputted sounds that are converted into digital signals by the ADC 22 and the musical sounds by the automatic accompaniment are recorded through overwriting on the recording memory 13*a*. It is noted that mixing of musical sounds is performed by the DSP 20.

After the process in S402, it is judged as to whether or not the START/STOP button 15*c* is operated (S403). When it is judged that the START/STOP button 15*c* is operated (S403: Yes), the processing proceeds to S412. On the other hand, when the START/STOP button 15*c* is not operated, and the judgment in S403 is negative (S403: No), it is judged as to whether or not the write address reaches a loop end point (S404). The loop end point used for the judgment in S404 is a loop end point set in S303, if the automatic accompaniment being executed is based on the automatic accompaniment pattern set in S302. On the other hand, the loop end point is a loop end point set in S308, if the automatic accompaniment being executed is based on the automatic accompaniment pattern set in S307.

When the automatic accompaniment has not reached the loop end point, and the judgment in S404 is negative (S404: No), the processing is returned to S402. At this time, the read address of the automatic accompaniment pattern and the write address of the recording memory 13*a* are incremented, respectively.

On the other hand, when the write address reaches the loop end point, and the judgment in S404 is affirmative (S404: Yes), in other words, the recording in the first round is completed, the write address of the recording memory 13*a* is returned to the recording start address (S405). After the process in S405, reading of the automatic accompaniment pattern is stopped, thereby stopping the automatic accompaniment (S406).

After the process in S406, the musical sounds (audio signals) recorded in the recording memory 13*a* are read out at a readout start address equivalent to the recording start address, thereby starting a loop reproduction (S407).

After the process in S407, recording in the second round in the loop recording is performed on the recording memory 13*a* by an overdubbing recording process (S408). More specifically, musical sounds read out from the recording memory 13*a* and musical sounds newly generated by the sound source 19 or externally inputted sounds newly inputted from the microphone 42 through the ADC 22 are mixed by the DSP 20, and the mixed sounds are recorded through overwriting at a position designated by the write address in the recording memory 13*a*. It is noted that the "musical sounds newly generated by the sound source 19" may be musical sounds generated and outputted by the sound source 19 based on performance information (manual performance information, external MIDI performance information) inputted from the keyboard 16 or the external MIDI equipment 43.

After the process in S408, it is judged as to whether or not the START/STOP button 15*c* is operated (S409). When it is judged that the START/STOP button 15*c* is operated (S409: Yes), the processing proceeds to S412. On the other hand, when it is judged that the START/STOP button 15*c* is not operated, and the judgment in S409 is negative (S409: No), it is judged as to whether or not the write address has reached a loop end point (S410). The loop end point used for the judgment in S410 is the loop end point used for the judgment in S404.

When the write address has not reached the loop end point, and the judgment in S410 is negative (S410: No), the processing is returned to S408. At this time, the write address and the read address of the recording memory 13*a* are respectively incremented.

On the other hand, when the write address has reached the loop end point, and the judgment in S410 is affirmative (S410: Yes), the write address of the recording memory 13*a* is returned to the recording start address (S411). At this time, the read address of the recording memory 13*a* is also returned to the readout start address, as the musical sound recorded in the recording memory 13*a* is returned to the beginning so as to be reproduced.

In S412 executed when it is judged, in S403 or S409, that the START/STOP button 15*c* is operated (S403: Yes, S409: Yes), the loop reproduction of the recording memory 13*a* is stopped (S412). After the process in S412, the loop recording is stopped (S413), the write address of the recording memory 13*a* is returned to the recording start address (S414), thereby ending the loop recording process, and the processing returns to the main process in FIG. 3.

Figure 5:
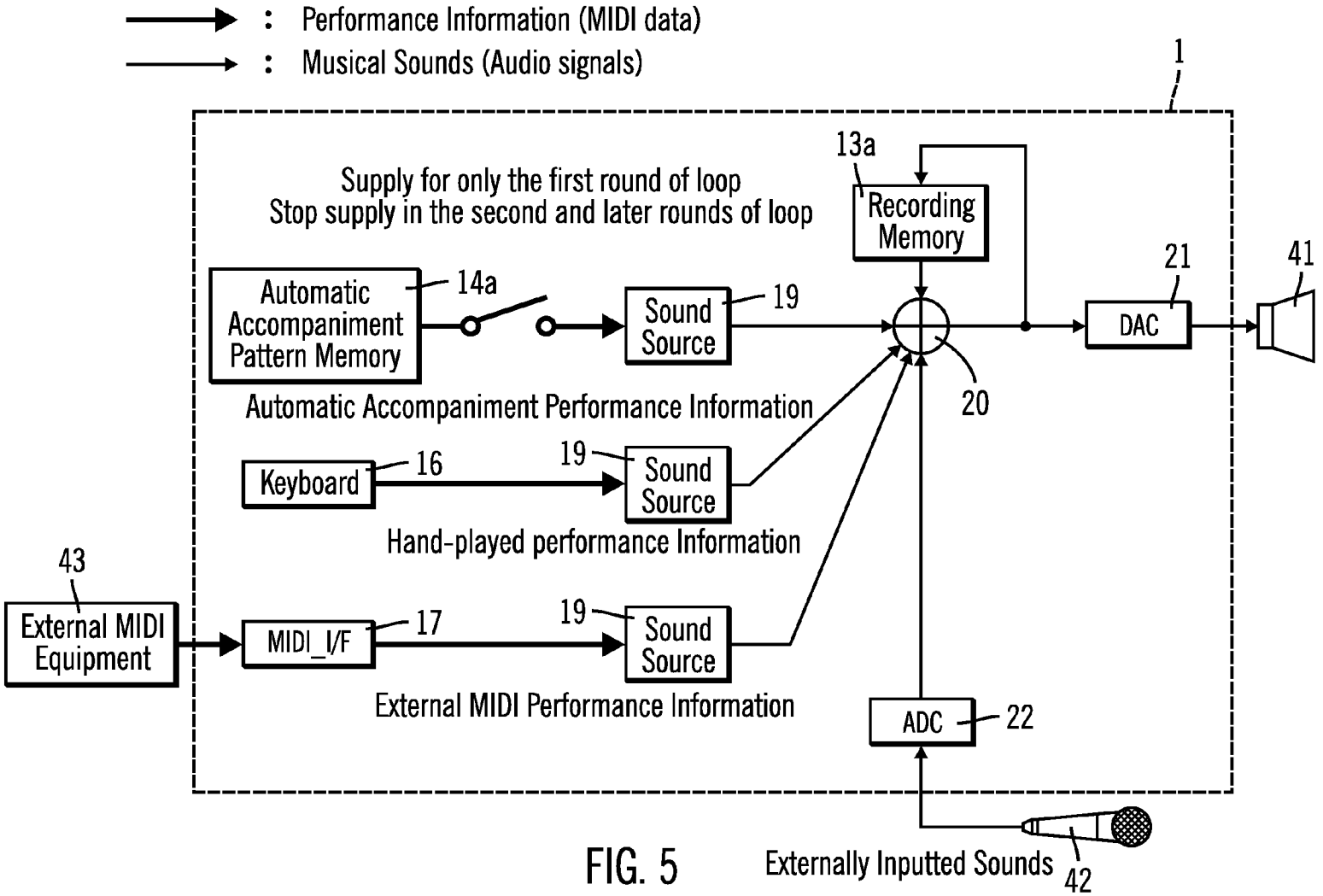
FIG. 5 is a routing diagram schematically showing the flow of performance information and musical sounds accompanied upon execution of the loop recording processing.

Referring to FIG. 5, effects obtained by the loop recording process described above will be described. FIG. 5 is a routing diagram schematically showing the flow of performance information and musical sounds taking place along with the loop recording process. It is noted that, in FIG. 5, arrowed thick lines indicate the flow of performance information (MIDI data), and arrowed thin lines indicate the flow of musical sounds (audio signals).

One of automatic accompaniment patterns (automatic accompaniment performance information) stored in the automatic accompaniment pattern memory 14*a* and selected by the performer manipulating the VALUE button 15*b* is supplied to the sound source 19. Musical sounds (audio signals)

are generated by the sound source 19 as accompaniment sounds based on the automatic accompaniment performance information, and are supplied to the DSP 20. It is noted that the automatic accompaniment performance information is supplied to the sound source 19 only at the time of recording in the first round, but its supply to the sound source 19 is stopped in the second and later rounds, as the automatic accompaniment is stopped in S406.

The electronic musical instrument 1 in accordance with the present embodiment may also use musical sounds based on performance information (manual performance information, external MIDI performance information) inputted as necessary from the keyboard 16 or the external MIDI equipment 43, and musical sounds inputted from a musical sound input device such as the microphone 42 as source material for loop phrases.

For example, when the performer performs with the keyboard 16, manual performance information based on the performance is supplied to the sound source 19, and musical sounds generated by the sound source 19 based on the manual performance information are supplied to the DSP 20. Also, when external MIDI performance information is supplied from the external MIDI equipment 43, the external MIDI performance information is supplied to the sound source 19 through the MIDI_I/F 17, and musical sounds generated by the sound source 19 based the external MIDI performance information are supplied to the DSP 20. Also, when externally inputted sounds such as human voice are inputted from the microphone 42, the externally inputted sounds are converted into digital signals by the ADC 22, and then supplied to the DSP 20.

At the time of recording in the first round, musical sounds (accompaniment sounds) generated by the sound source 19 based on the automatic accompaniment performance information are recorded through overwriting on the recording memory 13*a*. When at least one of manual performance information from the keyboard 16, external MIDI performance information from the external MIDI equipment 43 and externally inputted sounds from the microphone 42 is inputted, at the time of recording in the first round, musical sounds based on the performance information inputted and the externally inputted sounds inputted are mixed with accompaniment sounds based on the automatic accompaniment performance information by the DSP 20, the mixed sounds outputted from the DSP 20 are recorded through overwriting on the recording memory 13*a*. On the other hand, musical sounds (in other words, musical sounds including at least accompaniment sounds) outputted from the DSP 20 are also supplied to the DAC 21, converted into analog signals by the DAC 21, and then outputted as sounds from the speaker 41.

When the musical sounds including at least the accompaniment sounds are recorded on the recording memory 13*a* by the recording in the first round, loop reproduction of the musical sounds (in other words, the musical sounds including at least the accompaniment sounds) recorded on the recording memory 13*a* is started, and the reproduced musical sounds are supplied to the DSP 20.

As described above, at the time of recording in the second and later rounds, the automatic accompaniment is stopped, and therefore the supply of the automatic accompaniment performance information to the sound source 19 is stopped. Therefore, at the time of recording in the second and later rounds, reproduced sounds of the musical sounds recorded on the recording memory 13*a* and musical sounds based on performance information inputted from the keyboard 16 or the external MIDI equipment 43 and/or externally inputted sounds inputted from the microphone 42 through the ADC 22 are mixed (i.e., overdubbed) by the DSP 20, and the musical sounds outputted from the DSP 20 are recorded through overwriting on the recording memory 13*a*. On the other hand, even in the second and later rounds, the musical sounds outputted from the DSP 20 are supplied to the DAC 21, converted into analog signals by the DAC 21, and then outputted as sound from the speaker 41.

Therefore, according to the loop recording process described above with reference to FIG. 4, in the recording in the first round in the loop recording, musical sounds (accompaniment sounds) generated by automatic accompaniment based on an automatic accompaniment pattern are recorded on the recording memory 13*a*. However, the automatic accompaniment is stopped in S406, before the recording in the second round is started (before the execution of the overdub recording process in S408 starts). Therefore, in the recording in the second and later rounds, accompaniment sounds by the automatic accompaniment would not be overdubbed on the accompaniment sounds already recorded on the recording memory 13*a* in the recording in the first round. In this manner, the same accompaniment sounds based on the same automatic accompaniment pattern (automatic accompaniment performance information) are not overdubbed generally at the same timing. This is effective in preventing occurrence of flaws, such as, unintentional amplification of the level of waveforms, occurrence of timbres that sound like those with shifted phases and the like, whereby loop phrases obtained by the loop recording can be provided with good sound quality. Further, as the automatic accompaniment is stopped at the time of recording in the second and later rounds, the control load can accordingly be reduced.

Also, at the time of recording in the second and later rounds, the automatic accompaniment is stopped. However, as the accompaniment sounds have already been recorded on the recording memory 13*a* at the time of recording in the first round, the performer can continuously listen to the accompaniment sounds by reproduction of the musical sounds recorded on the recording memory 13*a*. Therefore, the performer can measure input timings of performance information and musical sounds to be overdubbed, while using the accompaniment sounds as guide sounds, whereby loop phrases by loop recording can be readily created.

As described above, according to the electronic musical instrument 1 in accordance with the present embodiment, in the second and later rounds in the loop recording, automatic accompaniment is stopped at the time of recording such that accompaniment sounds by the automatic accompaniment are not recorded overdubbed. As a result, loop phrases with good sound quality can be created. Loop phrases including accompaniment sounds are portable when they are stored in the USB 31, such that the loop phrases including the accompaniment sounds can be reproduced by any equipment as desired by the user.

The invention has been described above based on an embodiment, but it can be readily assumed that the invention is not at all limited to the embodiment described above, and various changes and modifications can be made within the range that does not depart from the subject matter of the invention.

For example, in accordance with the embodiment described above, as the accompaniment sounds, musical sounds generated by automatic accompaniment (automatic performance) based on performance information (MIDI data) are used. However, without being limited to the above, reproduced sounds of audio data, reproduced sounds of a metronome, clicks, etc. can be used as accompaniment sounds.

Also, the embodiment described above is configured such that, in S406 in the loop recording process (see FIG. 4), by stopping the automatic accompaniment, accompaniment sounds by the automatic accompaniment would not be overdubbed on the accompaniment sounds already recorded on the recording memory 13*a* in the recording in the first round. Instead of this configuration, in S406, the sound volume of accompaniment sounds generated by the automatic accompaniment may be configured to be muted (in other words, the level of audio signals is reduced to zero). In this case, in the second and later rounds in the loop recording, accompaniment sounds based on the automatic accompaniment are not substantially recorded on the recording memory 13*a*. Therefore it is possible to prevent occurrence of flaws, such as, unintentional level-amplification of the waveforms, occurrence of timbres that sound like those with shifted phases and the like, like the embodiment described above in which automatic accompaniment is stopped in loop recording in the second and later rounds, whereby loop phrases obtained can have good sound quality.

Alternatively, instead of stopping the automatic accompaniment, it can be configured that, in S406, the sound volume of accompaniment sounds generated by the automatic accompaniment may be made substantially small to the extent that the sound quality of loop phrases would not deteriorate.

When the configuration of muting the sound volume of accompaniment sounds generated by the automatic accompaniment in the second and later rounds in loop recording is used, the automatic accompaniment continues to be executed even in the second and later rounds in the loop recording. In such a case, reading of automatic accompaniment performance information is continuously performed, such that various kinds of display based on the readout performance information (for example, display of code progression and the like) can be outputted to the LCD 15*a*, which can give useful information to the performer for performance.

Also, in the embodiment described above, in S406 in the loop recording process (see FIG. 4), the automatic accompaniment is configured to stop by stopping the reading of the automatic accompaniment pattern. However, it may be configured to read out automatic accompaniment performance information, but not to supply the automatic accompaniment performance information to the sound source 19. Alternatively, it may be configured such that automatic accompaniment performance information is readout and supplied to the sound source 19 in the loop recording in the second and later rounds, but accompaniment sounds outputted from the sound source 19 are not stored on the recording memory 13*a* (excluded as a recording object).

Figure 6:
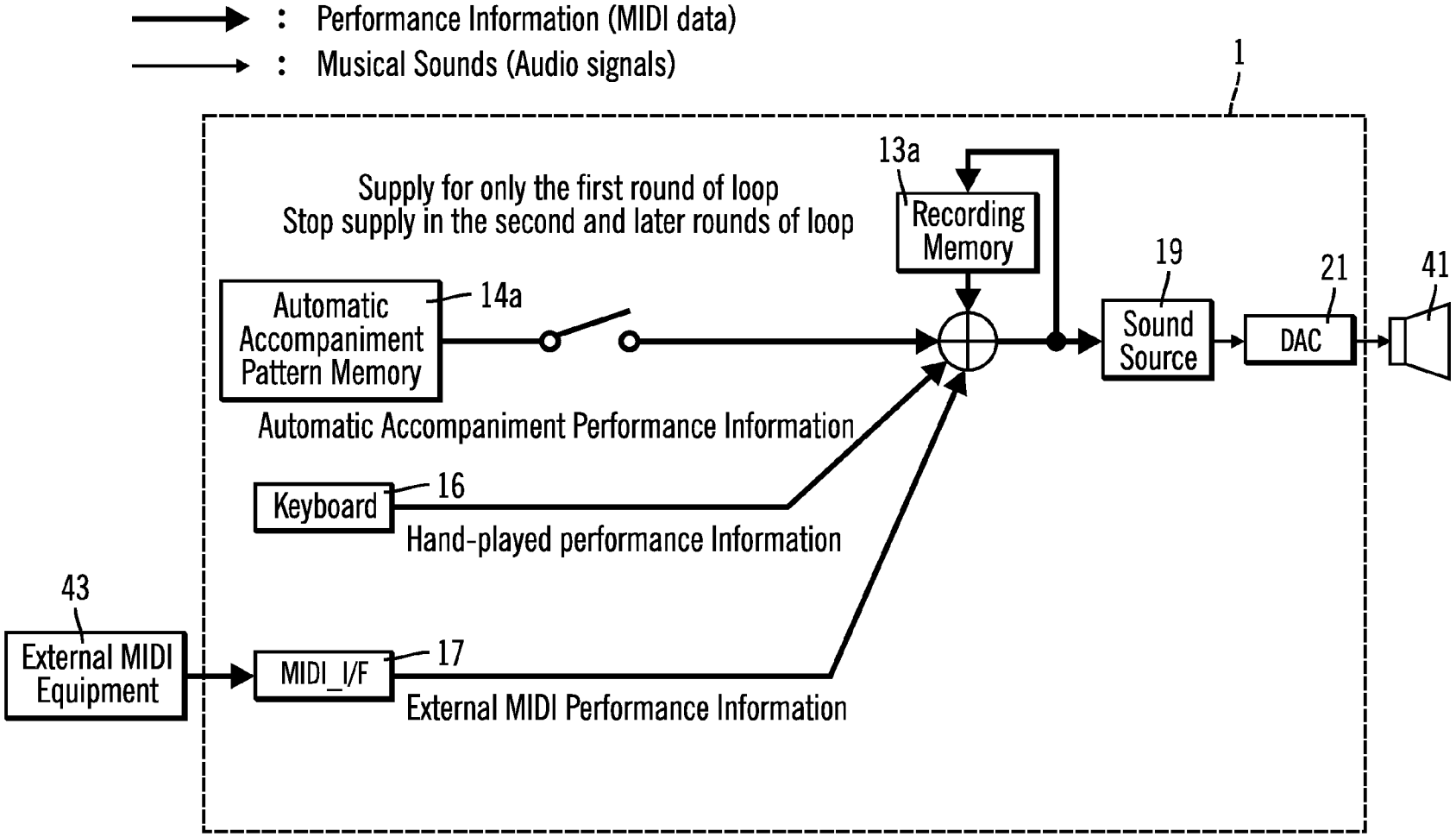
FIG. 6 is a routing diagram schematically showing the flow of performance information and musical sounds when recording performance information by loop recording.

Further, the embodiment described above is configured such that the recording memory 13*a* records musical sounds (audio signals), but it can be configured such that the recording memory 13*a* may record performance information (MIDI data) as a recoding object. FIG. 6 is a routing diagram schematically showing the flow of performance information and musical sounds when performance information is recorded (stored) by loop recording. It is noted that sections in FIG. 6 identical with those of the embodiment described above are appended with identical reference numbers, and their description will be omitted. Also, in this example, the DSP 20 may not be indispensable, unlike the electronic musical instrument 1 described above, and can be realized through connecting audio signals outputted from the sound source 19 directly to the DAC 21.

As shown in FIG. 6, automatic accompaniment performance information composing one of the automatic accompaniment patterns stored in the automatic accompaniment pattern memory 14*a* and selected by the performer is readout by the control of the CPU 11 and supplied as a recording material. It is noted that, like the embodiment described above, the automatic accompaniment performance information is readout only at the time of recording in the first round, and its readout is stopped (the automatic performance is stopped) at the time of recording in the second and later rounds, whereby supply of the automatic accompaniment performance information is stopped.

On the other hand, when the performer performs with the keyboard 16, manual performance information based on the performance is supplied as a recording material. Also, when external MIDI performance information is supplied from the external MIDI equipment 43, the external MIDI performance information is supplied as a recording material.

At the time of recording in the first round, at least, the automatic accompaniment performance information is recorded through overwriting on the recording memory 13*a*. When manual performance information from the keyboard 16 or external MIDI performance information from the external MIDI equipment 43 is inputted, at the time of recording in the first round, the inputted performance information is recorded together with the accompaniment performance information through overwriting on the recording memory 13*a*. On the other hand, the performance information (the performance information including at least the automatic accompaniment performance information) provided as the recording material is supplied to the sound source 19, musical sounds (audio signals) based on the supplied performance information are generated by the sound source 19, the generated musical sounds are supplied to the DAC 21 and converted by the DAC 21 into analog signals, and then outputted as sound from the speaker 41.

When the performance information including at least the automatic accompaniment performance information is recorded on the recording memory 13*a* in the recording in the first round, reading of the performance information is started in order to loop-reproduce musical sound based on the performance information recorded on the recording memory 13*a*, and the readout performance information is supplied as a recording material.

As described above, at the time of recording in the second and later rounds, the automatic accompaniment is stopped, and therefore supply of the automatic accompaniment performance information is stopped. Therefore, at the time of recording in the second and later rounds, the performance information (the performance information including at least the automatic accompaniment performance information) readout from the recording memory 13*a*, and performance information (manual performance information or external MIDI performance information) inputted from the keyboard 16 or the external MIDI equipment 43 are recorded together (in other words, with these performance information being combined) through overwriting on the recording memory 13*a*. On the other hand, even in the second and later rounds, the performance information after being combined is supplied to the sound source 19, musical sounds (audio signals) based on the supplied performance information are generated by the sound source 19, the musical sounds thus generated are supplied to the DAC 21 and converted by the DAC 21 into analog signals, and then outputted as sounds from the speaker 41.

Therefore, even when the object to be recorded on the recording memory 13*a* by loop recording is changed from musical sounds (audio signals) to performance information (MIDI data), in the recording in the second and later rounds, the automatic accompaniment is stopped, and therefore new automatic accompaniment information would not be overdubbed on the automatic accompaniment information already recorded on the recording memory 13*a* by the recording in the first round. Therefore, the same accompaniment sounds based on the same automatic accompaniment pattern (automatic accompaniment performance information) would not be outputted from the sound source 19 generally at the same timing. Therefore, it is possible to prevent occurrence of flaws in musical sound outputted from the sound source 19, such as, unintentional level-amplification of the waveforms, occurrence of timbres that sound like those with shifted phases and the like, whereby loop phrases obtained by the loop recording can be provided with good sound quality. Also, in the example shown in FIG. 6, at the time of recording in the second and later rounds, the automatic accompaniment is stopped. However, accompaniment sounds are generated based on the automatic accompaniment performance information already recorded on the recording memory 13*a* at the time of recording in the first round, such that the performer can continue listening to the accompaniment sounds.

Also, in the example shown in FIG. 6, at the time of recording in the second and later rounds in the loop recording, by stopping the automatic performance (in other words, by stopping readout of the automatic accompaniment performance information from the automatic accompaniment pattern memory 14*a*), supply of the automatic accompaniment performance information is stopped. However, the example may be configured such that reading of the automatic accompaniment performance information is continued, sound volume information included in the automatic accompaniment performance information readout is set to a value at which the level of audio signals generated by the sound source 19 based on the automatic accompaniment performance information becomes zero, and then the automatic accompaniment performance information may be supplied as a recording material. In this case, in the second and later rounds, the automatic accompaniment performance information is recorded on the recording memory 13*a*, but audio signals based on the automatic accompaniment information recorded (stored) in the second and later rounds are not substantially outputted from the sound source 19, and only audio signals based on the automatic accompaniment information recorded (stored) in the first round are generated. Therefore, like in the case of the embodiment described above, it is possible to prevent occurrence of flaws, such as, unintentional amplification of the level of waveforms, occurrence of timbres that sound like those with shifted phases and the like.

Alternatively, instead of stopping the reading of the automatic accompaniment performance information, the reading of the automatic accompaniment performance information may be continued, sound volume information included in the automatic accompaniment performance information readout may be set to a value at which the level of audio signals generated by the sound source 19 based on the automatic accompaniment performance information becomes a level sufficiently small to the extent that the sound quality of loop phrases would not be deteriorated, and then the automatic accompaniment performance information may be supplied as a recording material.

Also, like the example shown in FIG. 6, without stopping the supply of the automatic accompaniment performance information, reading of the accompaniment performance information may be continued, but the automatic accompaniment performance information readout may not be stored in the recording memory 13*a* (may not be made as a recording object).

Also, the embodiment described above is configured to record accompaniment sounds on the recording memory 13*a* from the start of recording in the first round in the loop recording. However, the start timing of recording the accompaniment sounds onto the recording memory 13*a* is not limited to the recording start time in the first round. Similarly, as in the case of the example shown in FIG. 6, when automatic accompaniment performance information is recorded on the recording memory 13*a*, the start timing of recording the automatic performance information to the recording memory 13*a* is neither limited to the start timing of recording in the first round. For example, it may be configured such that a loop recording may be started with the recording length of recording data (in other words, the length of a loop phrase) to be recorded on the recording memory 13*a* being set as the performance length of an automatic accompaniment pattern selected by the user, and recording of accompaniment sounds or automatic accompaniment information may be started at a timing desired by the user (for example, at the record start timing in the second round, in the middle of recording in the third round, etc.). As a trigger of the start of recording of accompaniment sounds or automatic accompaniment information, a button operation by the user may be exemplified. For example, it may be configured such that overdubbing of accompaniment sound onto reproduced sound of musical sound recorded on the recording memory 13*a* is started, when the user performs a button operation at a user's desired timing of the third round of the loop. In such a case, for example, after automatic accompaniment based on the automatic accompaniment pattern is performed once from the start to the end, it may be configured to execute the control described above that can prevent various flaws resulting from overdubbing of the accompaniment sounds, such as, by stopping the automatic accompaniment. By this, like the embodiment described above, the loop phrase obtained can be provided with good sound quality. It goes without saying that, when overdub-recording accompaniment sounds onto reproduced sounds, performance sounds or externally inputted sounds can be overdubbed together with the accompaniment sound.

Further, in the embodiment described above, information of the number of ticks and beats of an automatic accompaniment pattern and the current tempo are used to calculate a loop end point, and the loop end point is used as a trigger to judge as to whether the loop recording switches from the first round to the second round. However, it can be configured to judge as to whether the loop recording switches from the first round to the second round based on an operation by the user (for example, a button operation). More specifically, when the user operates the button, intending to end the first round, this operation may be used to judge that the second round in the loop recording is started.

Also, in the embodiment described above, the loop recording process (see FIG. 4) is configured to perform, in the first round in the loop, a process in which musical sounds are not readout from the recording memory 13*a*, musical sounds generated by the sound source 19 based on automatic accompaniment information and musical sounds generated by the sound source 19 based on manual performance information or the like are mixed, and recorded through overwriting on the recording memory 13*a* (the overwriting recording: S402); and in the second and later rounds in the loop, a process in which musical sounds readout from the recording memory 13*a*, and musical sounds generated by the sound source 19 based on manual performance information or the like are mixed, and recorded through overdubbing on the recording memory 13*a* (the overdubbing recording: S408). Instead, it is possible to configure such that the recording memory 13*a* may be initialized in advance by musical sound data whose values are zero; in the first round in the loop, musical sounds readout from the recording memory 13*a*, musical sounds generated by the sound source 19 based on the automatic accompaniment information, musical sounds generated by the sound source 19 based on manual performance information and the like may be mixed and recorded through overdubbing on the recording memory 13*a*. This also applies to the case where the recording object of the recording memory 13*a* is performance information (MIDI data).

Also, in the embodiments described above, the electronic musical instrument 1 is configured to have the USB I/F 18 connectable to the USB memory 31, and recording data recorded on the recording memory 13*a* may be stored in the USB memory 31 (the storage memory 31*a*). However, it can be configured to have a reader/writer for various media such as an SD card (registered trademark), and recording data recorded on the recording memory 13*a* may be stored in any of the various media, or it can be configured to be connectable to an external hard disk drive, and recorded data recorded on the recording memory 13*a* may be stored in the hard disk drive.

Moreover, in the embodiment described above, it is configured such that automatic accompaniment is performed based on an automatic accompaniment pattern stored in the flash memory 14 (the automatic accompaniment pattern memory 14*a*) built in the electronic musical instrument 1. However, it may be configured to perform automatic accompaniment through reading out an automatic accompaniment pattern stored in one of various media and a hard disk drive.

It is noted that musical sounds (in a predetermined segment) stored in the storage device may comprise musical sounds recorded on the recording memory 13*a* in the embodiments described above. Also, the performance information (in a predetermined segment) stored in the storage device may comprise performance information recorded on the recording memory 13*a* in the example shown in FIG. 6.

Also, accompaniment sounds may comprise the musical sounds generated by the sound source 19 based on automatic accompaniment information, accompaniment sounds obtained by reproduction of audio data, and accompaniment sounds obtained by reproduction of a metronome sound, clicks and the like. Also, "accompaniment sounds" recited in claim 2 correspond to the "musical sounds generated by the sound source 19 based on automatic accompaniment information" in the example shown in FIG. 6.

Also, performance sounds may comprise the musical sounds generated by the sound source 19 based on manual performance information, musical sounds generated by the sound source 19 based on external MIDI performance information, and externally inputted sounds inputted from a musical sound input device such as the microphone 42 through the ADC 22 in the embodiments described above or the example shown in FIG. 6. Performance sounds may also include musical sounds that are generated by the sound source 19 based on various kinds of performance information inputted as materials for loop phrases along with performance sounds, without any particular limitation to manual performance information and external MIDI performance information.

What is claimed:

1. An electronic musical instrument comprising:

an accompaniment sound generation device that sequentially generates accompaniment sounds;

a storage device that sequentially stores musical sounds;

a loop reproduction device that sequentially reads the musical sounds in a predetermined segment stored in the storage device while looping the predetermined segment to perform a loop reproduction;

a loop storage control device by which musical sounds sequentially readout from the storage device by the loop reproduction device and at least one of accompaniment sounds sequentially generated by the accompaniment sound generation device and performance sounds sequentially inputted are mixed, and sequentially stored in the storage device while looping the predetermined segment; and an accompaniment sound storage control device that controls the loop storage control device to store the accompaniment sounds sequentially generated by the accompaniment sound generation device in the storage device for only one round of a loop of the predetermined segment.

2. An electronic musical instrument comprising:

an accompaniment sound generation device that sequentially generates accompaniment sounds based on performance information;

a storage device that sequentially stores performance information;

a loop reproduction device that sequentially reads the performance information in a predetermined segment stored in the storage device while looping the predetermined segment to perform a loop reproduction;

a loop storage control device by which performance information sequentially readout from the storage device by the loop reproduction device and at least one of performance information of accompaniment sounds sequentially generated by the accompaniment sound generation device and performance information of performance sequentially inputted are merged, and sequentially stored in the storage device while looping the predetermined segment; and an accompaniment sound storage control device that controls the loop storage control device to store performance information of the accompaniment sounds sequentially generated by the accompaniment sound generation device in the storage device for only one round of a loop of the predetermined segment.

3. A method, comprising:

during a first loop recording, performing:

generating automatic accompaniment information from a storage device having patterns of automatic accompaniment information;

receiving first musical device input from at least one coupled musical device;

mixing the first musical device input with automatic accompaniment input based on the generated automatic accompaniment information to produce a first mixed output; and storing the first mixed output in a recording memory;

during a second loop recording following the first loop recording, performing:

outputting the first mixed output from the recording memory;

receiving second musical device input from the at least one coupled musical device while outputting the first mixed output;

mixing the received second musical device input and the first mixed output to produce second mixed output; and storing the second mixed output in the recording memory.

4. The method of claim 3, wherein the automatic accompaniment input based on the generated automatic accompaniment information comprises the automatic accompaniment information and wherein the first and second musical device inputs comprise performance information, wherein during the first loop recording, further performing:

transmitting the first mixed output to a sound source; and outputting, by the sound source, musical sounds based on the first mixed output, wherein the first mixed output includes the mixed generated automatic accompaniment information and the performance information from the at least one musical device before being processed by the sound source.

5. The method of claim 4, wherein during the second loop recording, further performing:

outputting, by the sound source, musical sounds based on the second mixed output, wherein the second mixed output includes the first mixed output comprising the automatic accompaniment information and the performance information mixed during the first loop recording and the received second musical device input.

6. The method of claim 3, wherein during the first loop recording:

outputting, by a sound source, first musical sounds from the automatic accompaniment information generated from the storage device, wherein the automatic accompaniment input comprises the musical sounds from the sound source;

outputting, by the sound source, second musical sounds from performance information from the at least one musical device, wherein the first musical device input comprises the second musical sounds from the sound source, wherein the first mixed output comprises the mixing of the first and second musical sounds.

7. The method of claim 6, wherein during the second loop recording, further performing:

outputting, by the sound source, third musical sounds from performance information from the at least one musical device, wherein the second musical device input comprises the third musical sounds from the sound source, outputting, by the sound source, fourth musical sounds based on the second mixed output, wherein the second mixed output includes the first mixed output and the third musical sounds received while outputting the musical sounds from the second mixed output.

8. The method of claim 3, wherein during the second loop recording, automatic accompaniment information is not generated from the storage device to provide to the mixing to produce the second mixed output during the second loop recording.

9. The method of claim 3, wherein during the second loop recording, further performing:

generating from the storage device the automatic accompaniment information configured so that any produced sounds from the automatic accompaniment information are muted, wherein the automatic accompaniment information generated from the storage device during the second loop recording is not included in the second mixed output and is not recorded on the recording memory with the second mixed output.

10. An electronic musical instrument coupled to at least one musical device, comprising:

a processing unit;

a recording memory;

automatic accompaniment pattern memory having patterns of automatic accompaniment information; and a computer storage device including a control program executed by the processing unit to perform operations, the operations comprising:

during a first loop recording, performing:

generating from the automatic accompaniment pattern memory automatic accompaniment information;

receiving first musical device input from the at least one musical device;

mixing the first musical device input with automatic accompaniment input based on the generated automatic accompaniment information to produce a first mixed output; and storing the first mixed output in the recording memory;

during a second loop recording following the first loop recording, performing:

outputting the first mixed output from the recording memory;

receiving second musical device input from the at least one musical device while outputting the first mixed output;

mixing the received second musical device input and the first mixed output to produce second mixed output; and storing the second mixed output in the recording memory.

11. The electronic musical instrument of claim 10, further comprising:

a sound source, wherein the automatic accompaniment input based on the generated automatic accompaniment information comprises the automatic accompaniment information and wherein the first and second musical device inputs comprise performance information, wherein during the first loop recording the operations further comprise:

transmitting the first mixed output to a sound source; and controlling the sound source to output musical sounds based on the first mixed output, wherein the first mixed output includes the mixed generated automatic accompaniment information and the performance information from the at least one musical device before being processed by the sound source.

12. The electronic musical instrument of claim 11, wherein during the second loop recording, the operations further comprise controlling the sound source to output musical sounds based on the second mixed output, wherein the second mixed output includes the first mixed output comprising the automatic accompaniment information and the performance information mixed during the first loop recording and the received second musical device input.

13. The electronic musical instrument of claim 10, further comprising:

a sound source, wherein during the first loop recording the operations further comprise:

controlling the sound source to output first musical sounds from the automatic accompaniment information generated from the storage device, wherein the automatic accompaniment input comprises the musical sounds from the sound source; and controlling the sound source to output second musical sounds from performance information from the at least one musical device, wherein the first musical device input comprises the second musical sounds from the sound source, wherein the first mixed output comprises the mixing of the first and second musical sounds.

14. The electronic musical instrument of claim 13, wherein during the second loop recording the operations further comprise:

controlling the sound source to output third musical sounds from performance information from the at least one musical device, wherein the second musical device input comprises the third musical sounds from the sound source; and controlling the sound source to output fourth musical sounds based on the second mixed output, wherein the second mixed output includes the first mixed output and the third musical sounds received while outputting the musical sounds from the second mixed output.

15. The electronic musical instrument of claim 10, wherein during the second loop recording, automatic accompaniment information is not generated from the storage device to provide to the mixing to produce the second mixed output during the second loop recording.

16. The electronic musical instrument of claim 10, wherein during the second loop recording the operations further comprise:

generating from the storage device the automatic accompaniment information configured so that any produced sounds from the automatic accompaniment information are muted, wherein the automatic accompaniment information generated from the storage device during the second loop recording is not included in the second mixed output and is not recorded on the recording memory with the second mixed output.

17. A computer storage device storing a control program executed by a processor in an electronic musical instrument to communicate with a storage device, a recording memory, and at least one musical device, and to perform operations, the operations comprising:

during a first loop recording, performing operations comprising:

generating automatic accompaniment information from the storage device having patterns of automatic accompaniment information;

receiving first musical device input from the at least one musical device;

mixing the first musical device input with automatic accompaniment input based on the generated automatic accompaniment information to produce a first mixed output; and storing the first mixed output in the recording memory;

during a second loop recording following the first loop recording, performing operations comprising:

outputting the first mixed output from the recording memory;

receiving second musical device input from the at least one musical device while outputting the first mixed output;

mixing the received second musical device input and the first mixed output to produce second mixed output; and storing the second mixed output in the recording memory.

18. The computer storage device of claim 17, wherein the code is further executed to communicate with a sound source, wherein the automatic accompaniment input based on the generated automatic accompaniment information comprises the automatic accompaniment information and wherein the first and second musical device inputs comprise performance information, wherein during the first loop recording, the operations further comprise:

transmitting the first mixed output to the sound source; and controlling the sound source to output first musical sounds based on the first mixed output, wherein the first mixed output includes the mixed generated automatic accompaniment information and the performance information from the at least one musical device before being processed by the sound source.

19. The computer storage device of claim 18, wherein during the second loop recording the operations further comprise:

controlling the sound source to output musical sounds based on the second mixed output, wherein the second mixed output includes the first mixed output comprising the automatic accompaniment information and the performance information mixed during the first loop recording and the received second musical device input.

20. The computer storage device of claim 17, wherein the code is further executed to communicate with a sound source, wherein during the first loop recording the operations further comprise:

controlling the sound source to output first musical sounds from the automatic accompaniment information generated from the storage device, wherein the automatic accompaniment input comprises the musical sounds from the sound source;

controlling the sound source to output second musical sounds from performance information from the at least one musical device, wherein the first musical device input comprises the second musical sounds from the sound source, wherein the first mixed output comprises the mixing of the first and second musical sounds.

21. The computer storage device of claim 20, wherein during the second loop recording the operations further comprise:

controlling the sound source to output third musical sounds from performance information from the at least one musical device, wherein the second musical device input comprises the third musical sounds from the sound source, outputting, by the sound source, fourth musical sounds based on the second mixed output, wherein the second mixed output includes the first mixed output and the third musical sounds received while outputting the musical sounds from the second mixed output.

22. The computer storage device of claim 17, wherein during the second loop recording, automatic accompaniment information is not generated from the storage device to provide to the mixing to produce the second mixed output during the second loop recording.

23. The computer storage device of claim 17, wherein during the second loop recording the operations further comprise:

generating from the storage device the automatic accompaniment information configured so that any produced sounds from the automatic accompaniment information are muted, wherein the automatic accompaniment information generated from the storage device during the second loop recording is not included in the second mixed output and is not recorded on the recording memory with the second mixed output.

* * * * *